United States Patent [19]

Michaloski

[11] 3,998,541

[45] Dec. 21, 1976

[54] ILLUMINATION ARRANGEMENT PROVIDING FOR INTERFRAME FLASHDOWN

[75] Inventor: Alfred J. Michaloski, Henrietta, N.Y.

[73] Assignee: Eastman Kodak Company, Rochester, N.Y.

[22] Filed: Apr. 18, 1975

[21] Appl. No.: 569,507

[52] U.S. Cl. ..... 355/11; 355/3 R; 355/67

[51] Int. Cl.[2] ..... G03G 15/00

[58] Field of Search ..... 355/3 R, 7, 11, 75, 355/67, 70, 8

[56] References Cited

UNITED STATES PATENTS

| | | | |
|---|---|---|---|
| 3,062,110 | 11/1962 | Shepardson et al. | 355/11 |
| 3,612,682 | 10/1971 | Shelffo | 355/14 |
| 3,724,942 | 4/1973 | Gibson | 355/3 R |
| 3,746,442 | 7/1973 | Davidson | 355/8 X |
| 3,788,737 | 1/1974 | Kidd | 355/7 X |
| 3,834,807 | 9/1974 | Fuller et al. | 355/8 X |

*Primary Examiner*—R. L. Moses
*Attorney, Agent, or Firm*—G. H. Childress

[57] ABSTRACT

Diffuse illumination is provided in document copying apparatus for illuminating both the document and an area surrounding the outside edges of the document. The surrounding area reflects illumination similar to the original document to flashdown interframe sections of the photoconductor. Compensation for reduced reflectivity in certain portions of this surrounding area is accomplished by appropriately located specular reflecting surfaces.

9 Claims, 6 Drawing Figures

ILLUMINATION ARRANGEMENT PROVIDING FOR INTERFRAME FLASHDOWN

BACKGROUND OF THE INVENTION

1. Field of the Invention

This invention relates generally to the field of electrophotography, and more particularly to means for providing interframe flashdown while illuminating and exposing reflection originals.

2. Description of the Prior Art

It is well known in electrophotography that a latent electrostatic image is formed on a photoconductor by exposing the photoconductor to light reflected from an original document. Frequently the document is illuminated through a transparent supporting platen and the resulting image is focused on the surface of the photoconductor through appropriate optics. In the case of a typewritten document, for example, the background is white, and reflects light through the optics to the photoconductor, while the typing is black, and absorbs light with very little reflection. The photoconductor then "sees", i.e., has projected onto its surface, a pattern or image-wise distribution of light and dark areas representing the background and typing, respectively, of the original document.

The photoconductor is uniformly charged electrostatically prior to its exposure, and the latent electrostatic image is produced by selectively discharging the photoconductor with the projected light pattern. This depletes the charge where the photoconductor is struck by light, and leaves a charge pattern in areas not struck by light (i.e., corresponding to the typed characters in the above example).

The latent image is developed in well known commercial devices by a fine black powder of thermoplastic material called toner, which is attracted to the photoconductor only in its charged areas to establish a visible or toned image. In some processes the photoconductor is consumed in generating the copy in the sense that it remains as the final support. In these processes the toned image is permanently fixed to the photoconductor itself, such as by heat fusing. In other processes the photoconductor is re-usable, and the toned image is transferred to another support, such as paper, to which it permanently is fixed.

Reference is made to U.S. Pat. No. 3,744,900 issued July 10, 1973 in the name of Jorgen Reesen, and to copending U.S. application Ser. No. 481,436, filed on June 20, 1974 in the name of William E. Hunt, et al., now U.S. Pat. No. 3,914,047, patented Oct. 21, 1975 for additional background. To facilitate this description, further discussion will assume processes, similar to those disclosed in said patent and application, which are of the transfer type and include an endless, flexible photoconductor of sufficient length to accommodate several latent or developed images simultaneously.

It should be understood that the image frames on the photoconductor are located with "unused" regions between said frames, i.e., the interframe areas, and with "unused" regions between the frames and the edges of the charge band, i.e., the edge areas. These interframe and edge areas are significant in the context of the present application because they are charged but not exposed to light reflected from the original document. Unless discharged in some manner, they attract and hold toner to the detriment of the machine's operation and its production of acceptable copies. Of course the toner in areas surrounding an image frame would not be transferred to copy paper perfectly registered with the frame, and the excess toner can be cleaned from the photoconductor before the involved section is recycled for its next exposure, but the following problems are some that still remain and have proved difficult to solve. (1) dark edges on the copy paper result from even slight misregister between the paper and the image frame, (2) excessive toner usage requires repeated shut down of the machine for refilling the toner supply, and (3) undesirable burdens are placed on the cleaning station and its power requirements in disposing of the excess toner. To further aggravate the matter, recently designed machines have improved capabilities for developing (toning) large solid areas, including the unused regions lying outside the exposure frames. In these machines the unused toner, discarded through a cleaning cycle, can exceed that which is used on the copies, thereby increasing the cost of running the machine by a significant amount per copy.

Techniques have been devised for avoiding the above noted problems, including, for example; electrical grounding, reverse charging, or special illumination, all of which are designed to remove the unwanted charge in the interframe or edge areas before development. A common technique is to provide an erase lamp capable of discharging the surface of the photoconductor outside of the image frames.

Turning now to a brief consideration of specific disclosures of interest, U.S. Pat. No. 3,792,913 issued to L. A. Simmons on Feb. 19, 1974, U.K. Pat. No. 1,292,571, published on Oct. 11, 1972 in the name of Fuji Foto Film Co., and U.K. Pat. No. 1,332,266 published on Oct. 3, 1973 in the name of Kabishiki Kaisha Ricoh, all disclose apparatus for earsing the charge in the edge areas of the photoconductor prior to development. The apparatus of U.S. Pat. No. 3,792,913 and U.K. Pat. No. 1,332,266 further provide for adjusting the size of the edge erase in accordance with the size of the copy to be produced.

U.S. Pat. No. 3,784,301, issued to M. Sato on Jan. 8, 1974, discloses the use of shields that protect the image frame while the entire border (interframe and edges) is illuminated. It is apparent that the Sato patent is directed primarily to apparatus in which the photoconductor is motionless during exposure.

U.S. Pat. No. 3,788,737, issued to W. L. Kidd on Jan. 29, 1974, shows a platen cover including a source of illumination for discharging the marginal areas surrounding the image frame. This illuminated cover is said to be especially useful when copying books or other thick originals.

U.S. Pat. No. 3,724,942, issued to D. K. Gibson and F. W. Johnson on Apr. 3, 1973, presents a mechanism including a shutter and mirror system for directing light rays to erase the interframe area.

The above mentioned references are directed to problems similar to those addressed by the present application, except that most relate only to edge erase where the solutions have been somewhat easier to attain than in the interframe areas. Where the interframe problem has been considered the proposed solutions have been complex and less than fully satisfactory from the commercial point of view. Extra lamps, single function shields, special timing and register circuits or additional mechanical apparatus generally have been required to accomplish the desired effect.

SUMMARY OF THE INVENTION

It is an object of the present invention to provide means for erasing the charge surrounding the image frame in an electrostatic copying process.

It is a further object of the invention to provide such a means that operates simultaneously with the image-wide exposure of the photoconductor and which does not require additional illumination sources or chargers.

It is another object in accordance with certain features of the invention to provide such a means suitable for use in copiers having continuously moving photoconductors that are exposed to the original document by a full-frame, flash exposure reflected from the document.

The present invention provides apparatus for illuminating a document and for exposing a photoconductor to light reflected from the document to establish a latent electrostatic image in the photoconductor. In accordance with a preferred embodiment, the apparatus includes a rectangular, transparent platen for supporting the document and elongated light sources located parallel to opposed edges of the platen for illuminating both the document and areas surrounding the outside edges of the document. The surrounding areas are defined by surfaces that are approximately the same as or greater in reflectivity than typical documents, in the wavelengths to which the photoconductor is sensitive, and provide for interframe and edge flashdown of the photoconductor. Compensation for reduced reflectivity in certain portions of this surrounding area is provided by specular reflecting surfaces located adjacent the lateral edges of the platen which enhance the light directed to the interframe areas and improve interframe flashdown of the photoconductor.

The invention and its objects and advantages will become more apparent in the detailed description of the preferred embodiment presented below.

BRIEF DESCRIPTION OF THE DRAWINGS

In the detailed description of the preferred embodiments of the invention presented below, reference is made to the accompanying drawing in which.

DESCRIPTION OF THE PREFERRED EMBODIMENT

Figure 1:
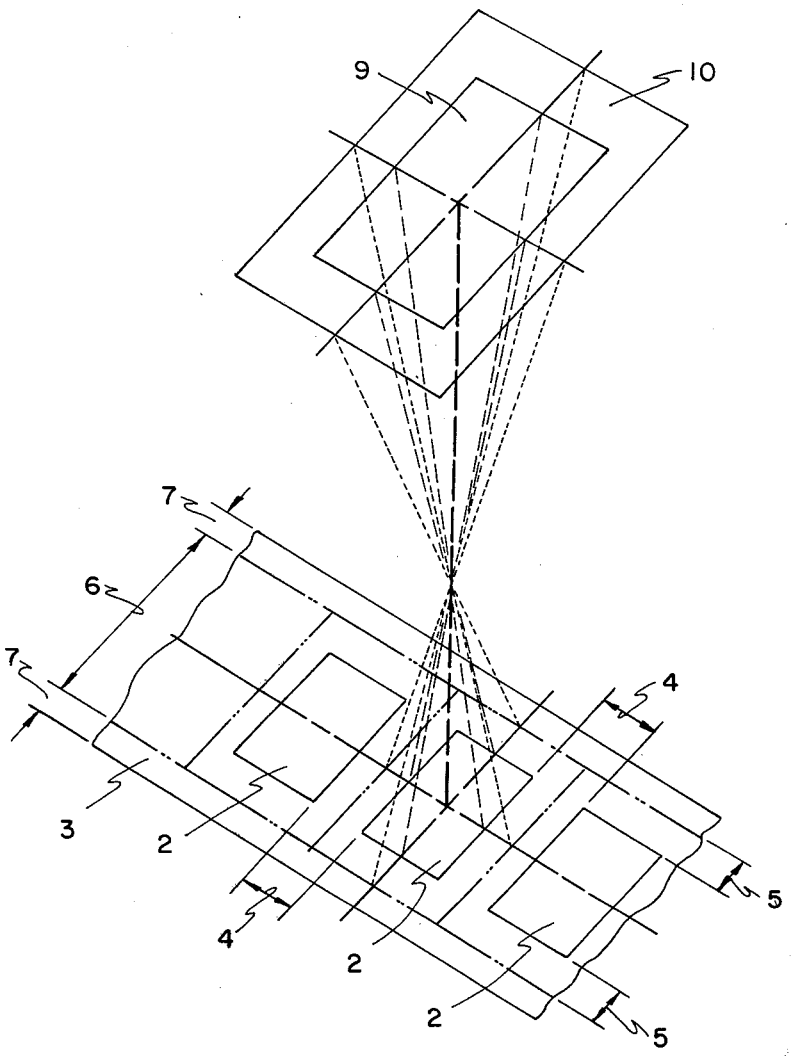
FIG. 1 is a schematic view of the document supporting and photoconductor areas involved in exposure and interframe flashdown.

A preferred embodiment of the present invention is illustrated in the drawings in connection with an office copier of the toner-transfer type employing an endless, flexible photoconductor of sufficient length to accommodate a plurality of image frames. As depicted in FIG. 1, image frames 2 of the photoconductor 3 are surrounded by non-image areas 4 and 5, which space the frames relative to each other and relative to the edges of a charge band 6. These areas 4 and 5, along with area 2, define the entire portion of the photoconductor that is charged, although there may be still some other portion 7 between the charge band and the very edges of the photoconductor. As will become more apparent, the image areas or frames 2 represent those sections of the photoconductor that are charged and exposed to light reflected from the object being copied, while the non-image areas 4 and 5 represent those sections that are charged but not exposed to light reflected from the object.

The object to be copied is represented in FIG. 1 by a document 9 which is surrounded by surfaces 10 extending outwardly from the edges of the document. The surfaces 10 are defined by the supporting structure that surrounds the document, including the platen cover and part of the illumination housing or machine frame. It is not necessary that such surfaces be in the same plane as or even parallel to the object to be copied, but they are within the field of view of the photoconductor, so that light will be projected from these surfaces onto the photoconductor in non-image areas to provide for interframe flashdown of the photoconductor.

Figure 2:
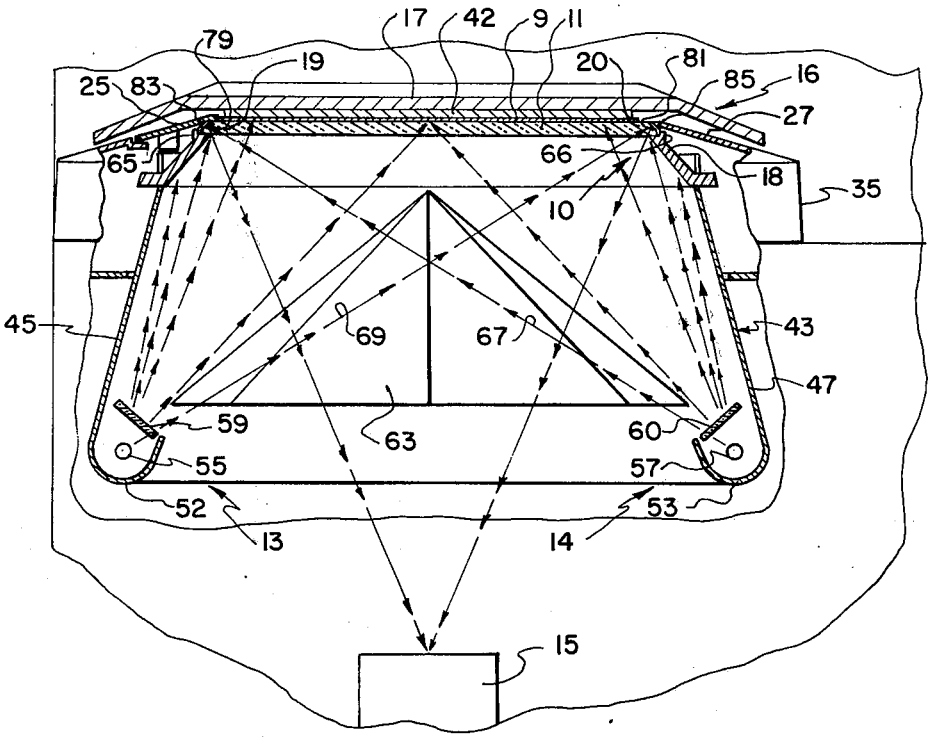
FIG. 2 is a partial end view of an illumination and exposure device including the document supporting surfaces providing for interframe flashdown and the specular surfaces for enhancing such flashdown.

Referring now to FIG. 2, the above-mentioned relationships are depicted in a preferred illumination station of an office copier. The document 9 is received on a transparent platen 11 in a position for reflecting light from first and second illumination sources 13 and 14 through an appropriate objective 15 and onto a respective one of the photoconductor frames 2 with sufficient intensity to establish a latent electrostatic image in the photoconductor. The areas outside the document, i.e., the above mentioned surfaces 10, are defined by the surrounding supporting structure 16 including a platen cover 17 and a platen frame 18. Light reflected from the surrounding supporting structure is projected by the objective 15 onto the photoconductor in the interframe and edge areas 5 and 7, thereby "flashing down" the charge in the portions of the photoconductor surrounding the image frame at the same time the photoconductor is exposed to the document.

Figure 4:
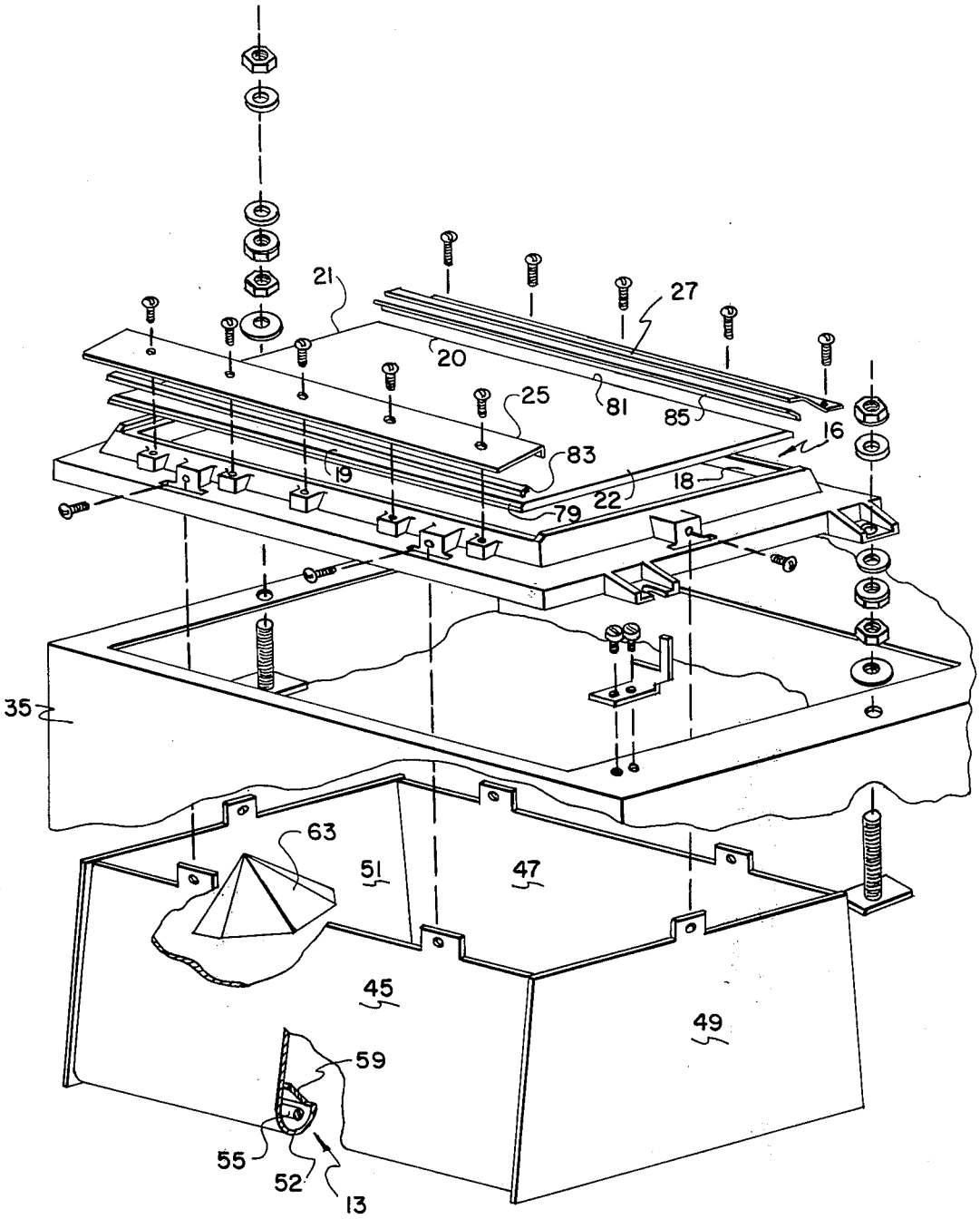
FIGS. 4–6 are exploded, side and top views respectively, of an exposure/illumination device incorporating the preferred embodiment of the present invention.

The platen is substantially rectangular in configuration, defining parallel first and second side edges 19 and 20 (FIG. 4) and parallel end edges 21 and 22 that extend between the side edges to complete the rectangle. Frame 18 surrounds and supports the platen at its edges, which are secured to the frame by clamps 25 and 27. Clamp 25 also overlies the first side edge of the platen to serve as an alignment edge against which the document can be positioned for copying. The surfaces of the frame are provided with a highly reflective surface, such as white enamel paint, so that most of the illumination that strikes the side walls is reflected in a diffuse manner, or non-directionally, approximately in accordance with a Lambertan distribution.

Figure 5:
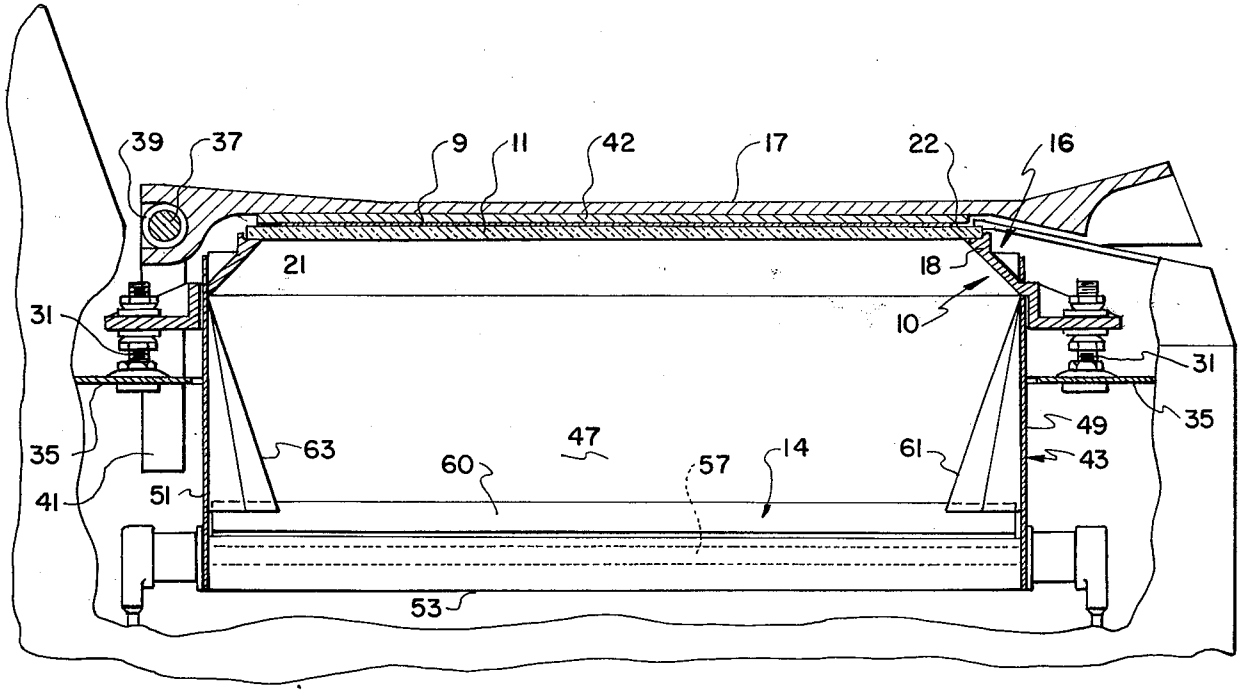
Figure 6:
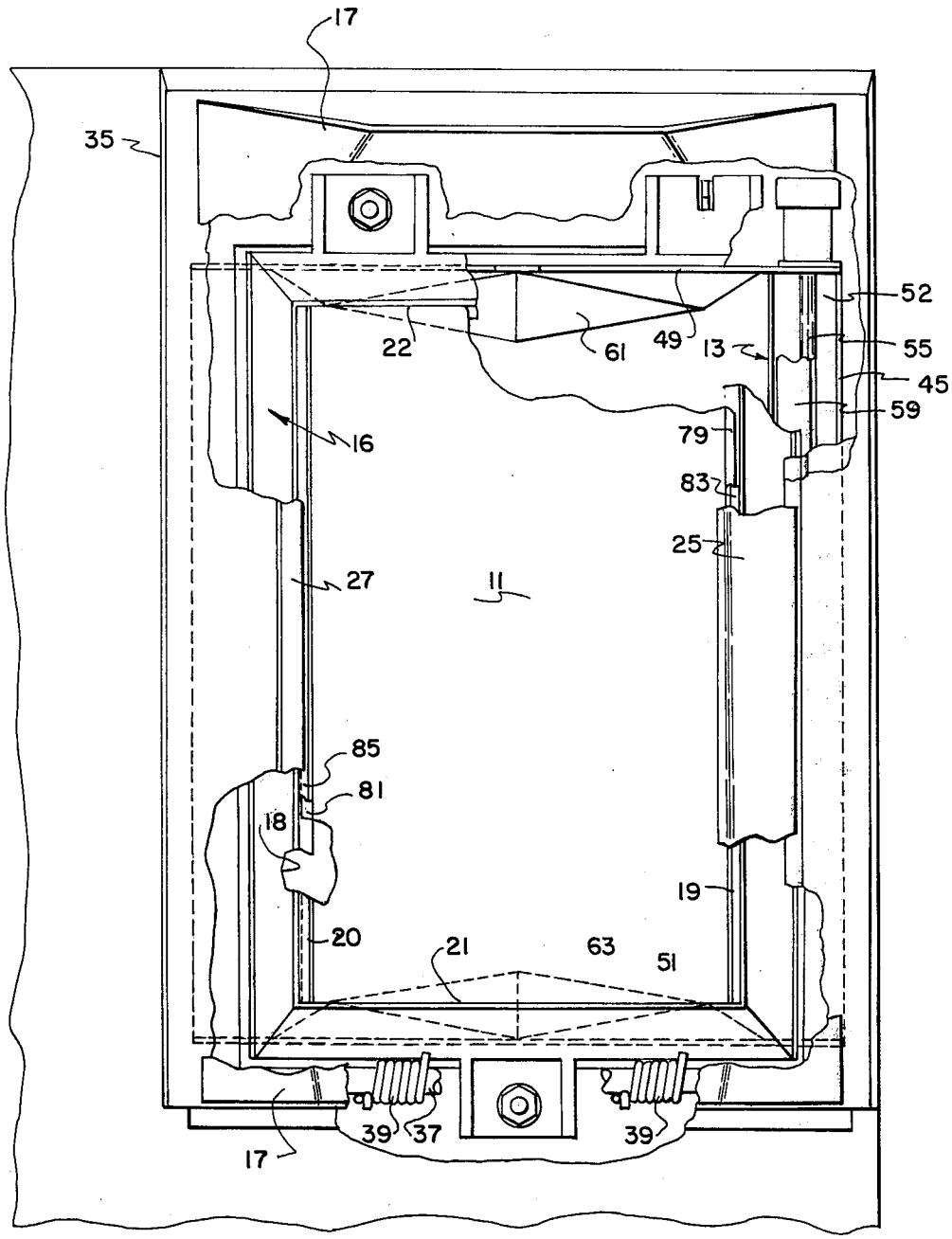

The platen cover 17 is mounted on the main frame 35 at one end of the platen 11. Platen cover 17 can be pivoted about a shaft 37 between a fully closed position, depicted in FIG. 5, where it extends over and covers the platen, and a fully open position (not shown) that permits the loading and unloading of documents on the platen. A clenching spring 39 (FIG. 6) is coupled to the platen cover 17 and grips the shaft 37 to hold the cover in whatever position it might be released between the fully closed and fully open positions. The cover 17 can also be moved vertically, relative to the platen, to facilitate the copying of books and other thick documents. For this purpose the shaft 37 is mounted on appropriate supporting studs 41 (FIG. 5)

for vertically shifting the shaft 37, and the pivoting axis of the cover, away from the platen. A resilient pad 42, comprised of a white matte vinyl is secured to the underside of the cover to engage and conform the document to the platen. Like the frame 18, the surface of pad 25 reflects light efficiently but in a diffuse manner.

A light box 43 is hung from the frame 18 and includes four panels or walls 45, 47, 49 and 51 that extend away from the platen and define a substantially rectangular cross-section that increases in area with distance from the platen. Two of the walls 45 and 47 oppose each other, extend substantially parallel to the side edges of the platen, and terminate in semi-cylindrical configurations 52 and 53 that enclose first and second elongated Xenon flash lamps 55 and 57 of illumination sources 13 and 14. The lamps are positioned on axes in the semi-cylindrical reflectors, parallel to and horizontal outside of the opposing side edges of the platen. Translucent diffuse shields 59 and 60 are positioned between the lamps 55 and 57 and the platen 11 to shield the operator from the direct rays of the lamps and to provide additional dispersion of the light emitting from lamps 55 and 57. The other two walls 49 and 51 support "roof-shaped" reflectors 61 and 63 that establish extended virtual images of the lamps 55 and 57 to increase the illumination at the ends of the platen.

The side walls 45 and 47, including the semi-cylindrical reflectors 52 and 53, are provided with highly reflective but diffuse surfaces like the platen frame 18 and serve as large diffuse secondary sources. The end panels 49 and 51, and the roof-shaped reflectors 61 and 63, on the other hand, are formed from specular aluminum sheets that efficiently and directionally reflect the illumination from sources 13 and 14. The specular surfaces do not change the diffuse characteristics of the illumination housing because they reflect only diffuse illumination.

The roof reflectors increase the illumination at the corners and also balance the illumination along the short side of the document within a minimum length illumination housing. An alternative procedure would call for angling the end panels 49 and 51 in a wedge shape fashion. This however would require extending the length of the illumination housing and would increase the necessary space envelope and perhaps machine size. In addition, the roof reflector scheme helps compensate for lens vignetting and fall off by providing additional illumination in the corners.

Figure 3:
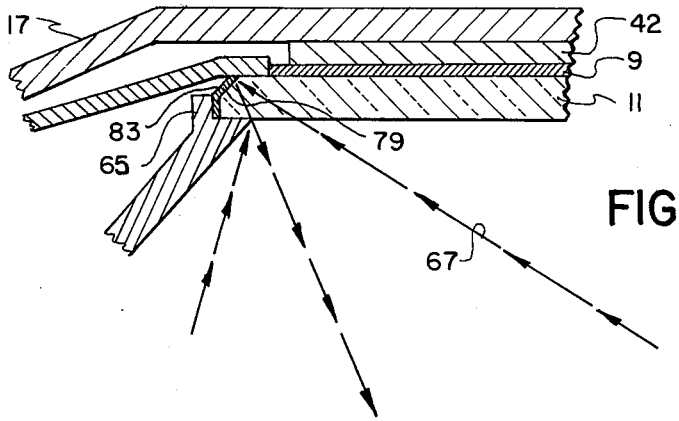
FIG. 3 is an enlargement of a portion of FIG. 2 illustrating in more detail the specular reflecting surfaces for enhancing interframe flashdown.

Referring now more specifically to FIGS. 2 and 3, and to the side edges of the platen where it is seated on supporting lips 65 and 66 of the platen frame 18. It should be noted that light rays striking the extreme edges of the platen ordinarily will not be reflected efficiently to objective 15 by any of the document, or the platen cover. This is due in part to the fact that the first edge 19 of the platen is not visible to the closest source of illumination 13, and to the fact that the edges of the platen, which are transparent, channel light into corners from which it is not reflected back towards the objective. If left uncorrected the interface between the platen and platen frame would be "seen" by lens 15, and interframe area 4, as being somewhat darker than the immediately surrounding areas of the platen and frame, resulting under some circumstances in reduced flashdown of the interframe area. The problem is overcome according to a preferred embodiment of the present invention by providing the platen 11 with beveled edges 79 and 81 for locating reflective surfaces 83 and 85 parallel to the lamps 55 and 57 and at an appropriate angle for reflecting light from the lamps back toward the objective 15. It will be noted in FIG. 3 that the angle of the bevel has been selected so that the edge 79, for example, which is not visible to its closest illumination source 13, will compensate by directionally reflecting light from the opposite illumination source 14. The degree of reflection desired may be obtained by using a specular surface finish that directionally reflects light so that it will be projected by the objective 15 onto photoconductor interframe area 4. A particularly convenient method of providing the reflecting surface is to attach strips of reflective tape to the beveled edges 79 and 81. However any of the well known methods for obtaining a reflective surface may be used. The term specular surface as used herein can be any surface having a finish which directionally reflects incident light rays, including semi-specular surfaces. In fact, semi-specular surfaces may be preferred for certain embodiments of this invention. Such a semi-specular surface can be defined for purposes of this invention as a surface having properties similar to those of a specular surface except that the directionally reflected light ray diverges somewhat with distance from the semi-specular reflecting surface.

FIGS. 2 and 3 illustrate how light rays 67 and 69, which ordinarily would be lost at the edges of the platen, are directed back toward the objective lens 15. Ray 67, which emanates from lamp 57 is reflected by opposite surface 83. Similarly, light ray 69 from lamp 55 is reflected by surface 85.

It should now be apparent from the above description that the present invention provides significant advantages over the prior art. Interframe flashdown of the photoconductor is accomplished simultaneously with document exposure and without requiring additional corona chargers or sources of illumination. By appropriate compensation in certain areas of reduced reflectivity, the platen frame and other areas surrounding the object to be copied can be used for flashdown with improved results.

The invention has been described in detail with particular reference to preferred embodiments thereof, but it will be understood that variations and modifications can be effected within the spirit and scope of the invention.

I claim:

1. A copier including a photoconductor for establishing a latent electrostatic image of an object to be copied, said copier comprising:

supporting structure including a transparent platen for supporting in a first area the object to be copied, said structure defining surfaces in a second area outwardly adjacent said first area having properties suitable for diffusely reflecting light to the photoconductor;

flash means for simultaneously illuminating the object and said second area with diffuse light to which the photoconductor is sensitive;

means for projecting light reflected from the object onto said photoconductor in an area defining an image frame on said photoconductor, and for projecting light from said second area onto said photoconductor defining an interframe on said photoconductor in a area outside and adjacent said image frame; and directional reflecting means in said second area for enchancing the light reflected from said area and projected onto said interframe; said directional reflecting means defining a surface oriented to direct light from said illuminating means toward said projecting means.

2. The copier of claim 1 wherein said platen defines first and second parallel exposed edges, and said directional reflecting means extends along said first and second edges.

3. Projecting apparatus for use in a document copier, said apparatus comprising:

a platen for supporting in a first area a document to be copied, said platen including a longitudinal edge at which the document is aligned for copying;

means defining white surfaces outside said first area, said surfaces having properties for efficiently reflecting light in a diffuse manner; and means defining a specular reflecting surface running longitudinally adjacent said edge for enhancing the reflecting properties outside said first area at said edge and for directing light away from said platen.

4. In a copier having a transparent platen supported in an opaque frame, means for illuminating said platen and said frame, a photoconductor, and means for focusing an image from said platen onto an area of said photoconductor and for projecting light reflected from said opaque frame onto said photoconductor outwardly of said area, the improvement wherein:

said platen includes a beveled edge locating a specular reflective surface, said beveled edge and said surface extending at an angle for directionally reflecting light from said illumination means toward said focusing and projecting means for enhancing the light reflected from adjacent said frame to said photoconductor outwardly of said area.

5. In a document copier including a flat, substantially rectangular platen for supporting in a first area a document to be copied, said platen defining an edge at which the document is to be aligned, and an opposite edge, and being supported at said edges on a frame; an endless flexible photoconductor for establishing a latent electrostatic image representing the document, the photoconductor being driven to move continuously in an endless path during a copy cycle when the photoconductor is exposed to the document; means for flashing the document with diffuse illumination and for exposing the photoconductor to light reflected from the document to establish the latent image in the photoconductor and thereby defining an image frame on the photoconductor, said means including first and opposite sources of illumination extending parallel to said edge and said opposite edge, respectively; the improvement wherein:

said frame includes means adjacent said first area defining a white surface having suitable properties for efficiently and diffusely reflecting light from said flashing means;

said means for flashing the document and exposing the photoconductor exposes the photoconductor outside said image frame to light reflected from said white surface means of said frame; and means are provided at said alignment edge of said platen defining an elongate specular reflecting surface for efficiently and directionally reflecting light from said opposite source of illumination to said photoconductor outside said image area to compensate for losses in light reflected from adjacent said alignment edge.

6. An illumination-exposure device for use with an electrostatically charged multiframe photoconductor defining pairs of frames and having an interframe area associated with at least one such pair, said device comprising:

a transparent platen for supporting the document to be illuminated and exposed, said platen being substantially rectangular and having first and second opposed parallel edges;

an illumination source having first and second elongated lamps, said first lamp being located outside of and parallel to said first edge of said platen and said second lamp being located outside of and parallel to said second edge of said platen;

said platen having first reflection means located at said first edge of said platen for directing a portion of the light from said second lamp to the interframe area of the photoconductor.

7. The illumination-exposure device of claim 6 having a second interframe area associated with another pair of frames on an opposite side of a frame from the first mentioned interframe area, and wherein said platen has a second reflection means located at said second edge for directing a portion of the light from said first lamp to said second-interframe area of the photoconductor.

8. The illumination-exposure device of claim 7 wherein said first and second edges of said platen are bevelled and said first and second reflection means are located respectively on said bevelled edges.

9. The illumination-exposure device of claim 8 wherein said reflective surface on said bevelled edge comprises a strip of reflective tape.

* * * * *